US008797175B2

(12) United States Patent
Huang et al.

(10) Patent No.: US 8,797,175 B2
(45) Date of Patent: Aug. 5, 2014

(54) ELECTRONIC APPARATUS AND SENSORY WARNING GENERATING METHOD THEREOF

(75) Inventors: Hsiao-Chuan Huang, Taoyuan County (TW); Meng-Sheng Chiang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 227 days.

(21) Appl. No.: 13/267,896

(22) Filed: Oct. 7, 2011

(65) Prior Publication Data

US 2013/0088357 A1 Apr. 11, 2013

(51) Int. Cl.

| | |
|---|---|
| ***G08B 21/00*** | (2006.01) |
| ***G08B 13/00*** | (2006.01) |
| ***G08B 6/00*** | (2006.01) |

(52) U.S. Cl.
CPC . *G08B 13/00* (2013.01); *G08B 6/00* (2013.01)
USPC ..... 340/686.1; 340/540; 340/541

(58) Field of Classification Search
CPC ..... G08B 3/00; G08B 5/00; G08B 6/00; G08B 7/00; G08B 13/00
USPC ..... 340/686.1
See application file for complete search history.

(56) References Cited

U.S. PATENT DOCUMENTS

| | | | | |
|---|---|---|---|---|
| 5,546,071 | A * | 8/1996 | Zdunich | 340/541 |
| 6,762,686 | B1 * | 7/2004 | Tabe | 340/573.1 |
| 2003/0083058 | A1 | 5/2003 | Mayer | |
| 2004/0110544 | A1 * | 6/2004 | Oyagi et al. | 455/575.1 |
| 2004/0130624 | A1 * | 7/2004 | Ryley et al. | 348/155 |
| 2007/0224933 | A1 | 9/2007 | Mayer | |
| 2009/0268030 | A1 | 10/2009 | Markham | |
| 2009/0318135 | A1 | 12/2009 | Wu et al. | |
| 2010/0261505 | A1 | 10/2010 | Yeh et al. | |
| 2011/0003577 | A1 * | 1/2011 | Rogalski et al. | 455/404.1 |
| 2011/0219334 | A1 * | 9/2011 | Park | 715/808 |

FOREIGN PATENT DOCUMENTS

| | | |
|---|---|---|
| CN | 101216977 | 7/2008 |
| CN | 201178430 | 1/2009 |
| CN | 201585044 | 9/2010 |
| CN | 101980519 | 2/2011 |
| TW | 200638192 | 11/2006 |
| TW | 200744362 | 12/2007 |
| TW | M331711 | 5/2008 |
| TW | M406786 | 7/2011 |
| ZA | 200209548 A * | 3/2003 |

OTHER PUBLICATIONS

"Office Action of Taiwan counterpart application" issued on Oct. 21, 2013, p. 1-p. 8.
"Office Action of China Counterpart Application" , issued on May 22, 2014, p. 1-p. 8.

* cited by examiner

*Primary Examiner* — Kerri McNally
(74) *Attorney, Agent, or Firm* — Jianq Chyun IP Office

(57) ABSTRACT

An electronic apparatus and a sensory warning generating method thereof are provided. The electronic apparatus includes a cradle and a handheld electronic device. The cradle has a motion sensor, and the handheld electronic is installed on the cradle and has a microprocessor, wherein the cradle or the handheld electronic device may has a warning indicator. The motion sensor is capable of detecting a motion of a object to produce a detection result, and the microprocessor drives the warning indicator in accordance with the detection result, such that the warning indicator produces a sensory warning.

21 Claims, 4 Drawing Sheets

ELECTRONIC APPARATUS AND SENSORY WARNING GENERATING METHOD THEREOF

BACKGROUND OF THE INVENTION

1. Technical Field

The disclosure generally relates to an electronic apparatus and a sensory warning generating method thereof, and more particularly, to an electronic apparatus with a motion sensor and a sensory warning generating method thereof.

2. Background

Along with the development of science and technology, many handheld electronic devices are put on the market, for example, a smartphone, a tablet PC and an eBook. The above-mentioned handheld electronic devices not only facilitate the daily life of people, but also play an indispensable in the life.

Taking a smartphone as an example, in addition to the conventional mobile phone function, the smartphone may be also connected to other peripheral devices, for example, an earphone and a charger for providing different functions. When a smartphone, for example, is connected to an earphone, the user may listen to music without interfering other people. In addition, when a smartphone is connected to a charger, the smartphone may be charged.

In fact, by combining the handheld electronic device with other peripheral devices, variety of applications may be expected to meet the requirement of users.

SUMMARY OF THE INVENTION

Accordingly, the disclosure is directed to an electronic apparatus, which has a motion sensor to make a warning indicator disposed at a handheld electronic device generate a sensory warning.

The disclosure is also directed to an electronic apparatus, which has a motion sensor to make a warning indicator disposed at a cradle generate a sensory warning.

The disclosure is further directed to a sensory warning generating method able to generate a sensory warning through the above-mentioned electronic apparatus.

The disclosure provides an electronic apparatus, which includes a cradle and a handheld electronic device. The cradle has a motion sensor. The handheld electronic device is installed onto the cradle and has a microprocessor and a warning indicator, in which the motion sensor is able to detect a motion of an object to generate a detection result and the microprocessor drives the warning indicator to generate a sensory warning according to the detection result.

The disclosure provides an electronic apparatus, which includes a cradle and a handheld electronic device. The cradle has a motion sensor and a warning indicator. The handheld electronic device is installed onto the cradle and has a microprocessor, in which the motion sensor is able to detect a motion of an object to generate a detection result and the microprocessor drives the warning indicator to generate a sensory warning according to the detection result.

The disclosure provides a sensory warning generating method, and the method is suitable for a cradle and a handheld electronic device. The cradle has a motion sensor, the handheld electronic device is installed on the cradle and has a microprocessor, and a warning indicator is disposed on the cradle or the handheld electronic device. The motion sensor detects a motion of an object so as to generate a detection result. The microprocessor drives the warning indicator according to the detection result so as to generate a sensory warning.

Based on the description above, the cradle of the disclosure has a motion sensor and the warning indicator is disposed on the handheld electronic device or the cradle. After the handheld electronic device is installed onto the cradle and the motion sensor detects out a motion of an object, the warning indicator may generate a sensory warning.

Other objectives, features and advantages of the present disclosure will be further understood from the further technological features disclosed by the embodiments of the present disclosure wherein there are shown and described preferred embodiments of this disclosure, simply by way of illustration of modes best suited to carry out the disclosure.

DETAILED DESCRIPTION OF DISCLOSED EMBODIMENTS

Figure 1A:
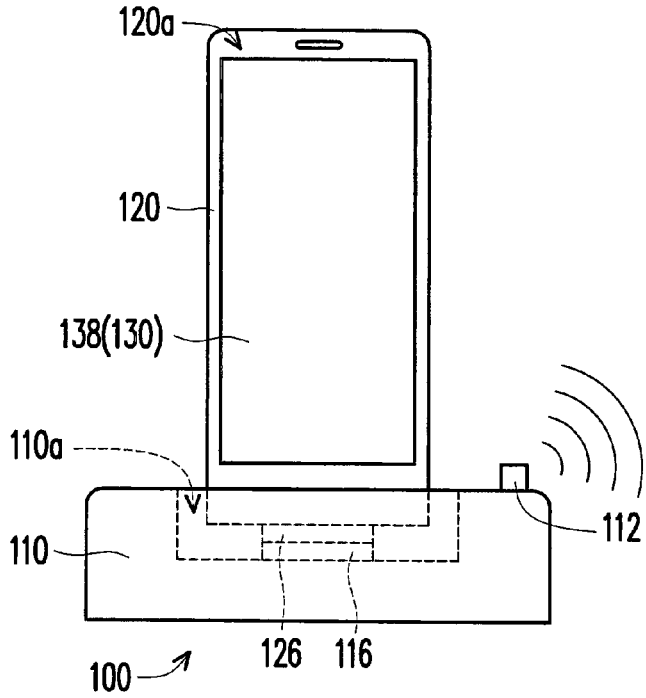
FIGS. 1A and 1B are respectively a front-view diagram and a side-view diagram of an electronic apparatus in a state according to an embodiment of the disclosure.
Figure 1B:
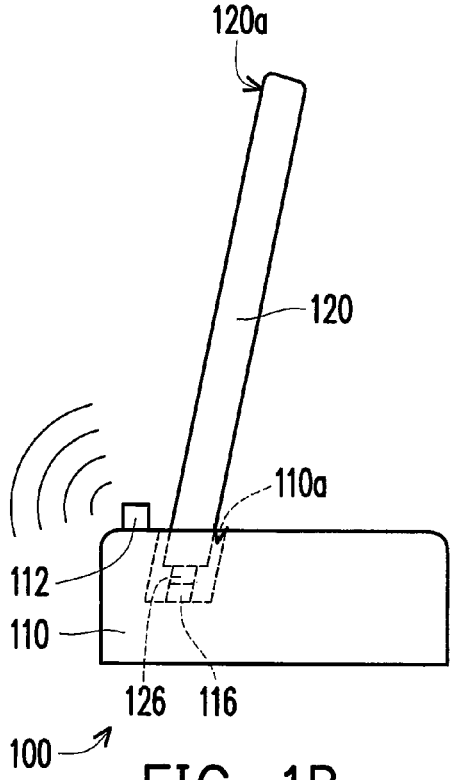
Figure 2:
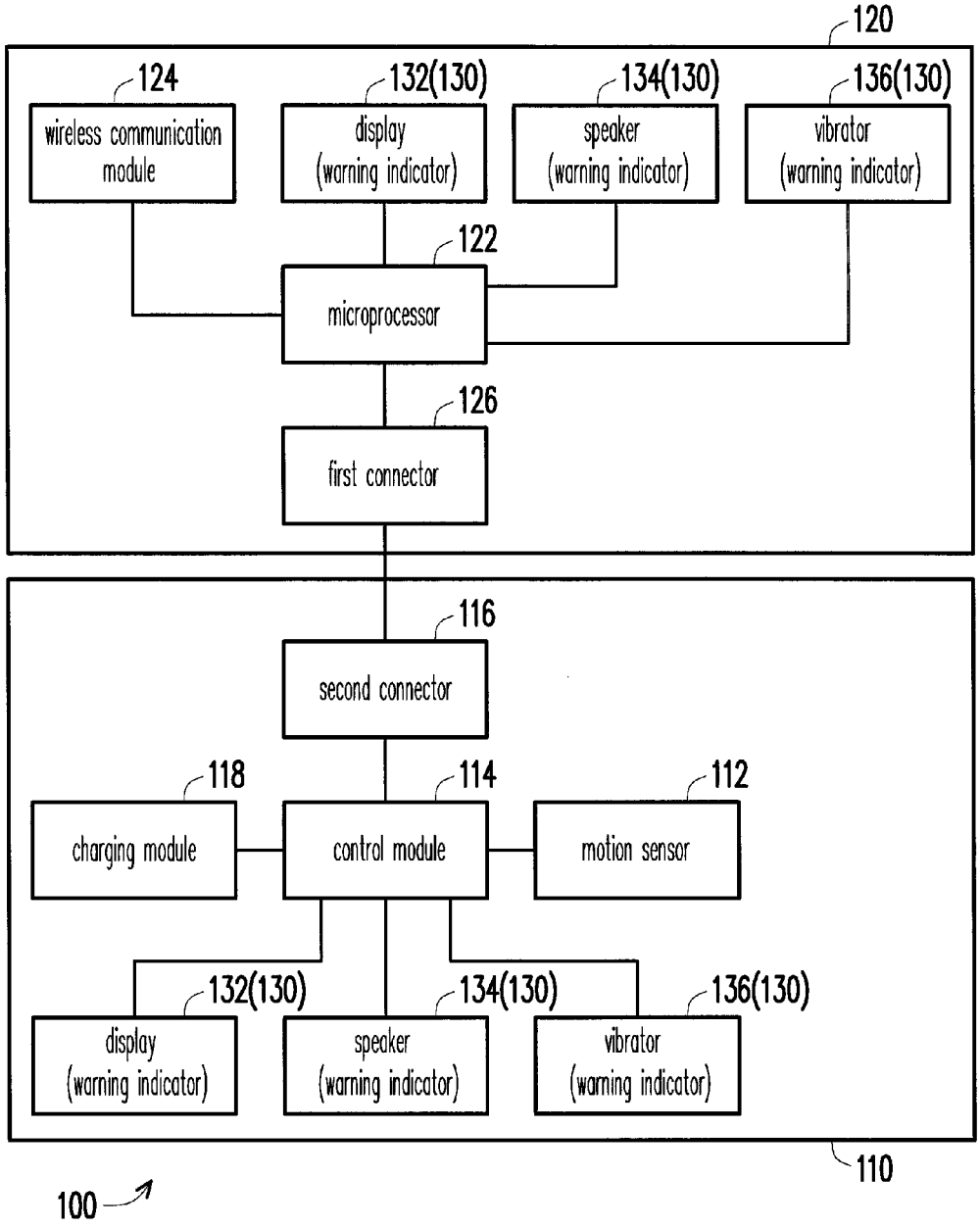
FIG. 2 is a block diagram of the electronic apparatus of FIG. 1A.

FIGS. 1A and 1B are respectively a front-view diagram and a side-view diagram of an electronic apparatus in a state according to an embodiment of the disclosure, and FIG. 2 is a block diagram of the electronic apparatus of FIG. 1A. Referring to FIGS. 1A, 1B and 2, an electronic apparatus 100 of the embodiment includes a cradle 110, a handheld electronic device 120 and a warning indicator 130. The handheld electronic device 120 is, for example, a smartphone, a tablet PC and an eBook.

The handheld electronic device 120 is installed onto the cradle 110 and has a microprocessor 122. The warning indicator 130 may be disposed on the handheld electronic device 120 or the cradle 110. The cradle 110 has a motion sensor 112. The motion sensor 112 may detect a motion of an object (not shown) to generate a detection result and the microprocessor 122 drives the warning indicator 130 to generate a sensory warning according to the detection result, in which the warning indicator 130 is a combination selected from a group consisting of a display 132, a speaker 134 and a vibrator 136, and the sensory warning is a message for a user to receive and is a combination selected from a group consisting of an optical signal, an acoustic signal and a vibration signal. The applications of the handheld electronic device 120 and the cradle 110 after combining them are expanded through generating the sensory warning.

In more details, the warning indicator 130 of the embodiment may be disposed at the handheld electronic device 120. After the handheld electronic device 120 is installed at the cradle 110, the motion sensor 112 of the cradle 110 starts to detect the present environment (as shown in FIGS. 1A and 1B). When the motion sensor 112 has detected out a motion in the present environment, for example, a motion of human body, the motion sensor 112 generates a detection result according to the motion of human body and sends the detection result to the microprocessor 122 (as shown by FIG. 2). The microprocessor 122 accordingly controls the warning indicator 130 to generate a sensory warning according to the detection result. In addition, the microprocessor 122 may set a threshold. When the signal detected by the motion sensor 112 is over the threshold, the warning indicator 130 is triggered, in which the threshold may be a fixed value or a mobile detection definition.

In addition, the warning indicator 130 of the embodiment may be also disposed on the cradle 110, and the cradle 110 further has a control module 114. The control module 114 is electrically connected to the motion sensor 112 so as to transmit the detection result to the microprocessor 122. When the warning indicator 130 is disposed on the cradle 110 and electrically connected to the control module 114, the microprocessor 122, by using the control module 114 to drive the warning indicator 130, generates a sensory warning according to the detection result. The electronic apparatus 100 of the embodiment may further have a plurality of warning indicators 130 respectively disposed on the handheld electronic device 120 and the cradle 110 to generate a plurality of sensory warnings.

Figure 3A:
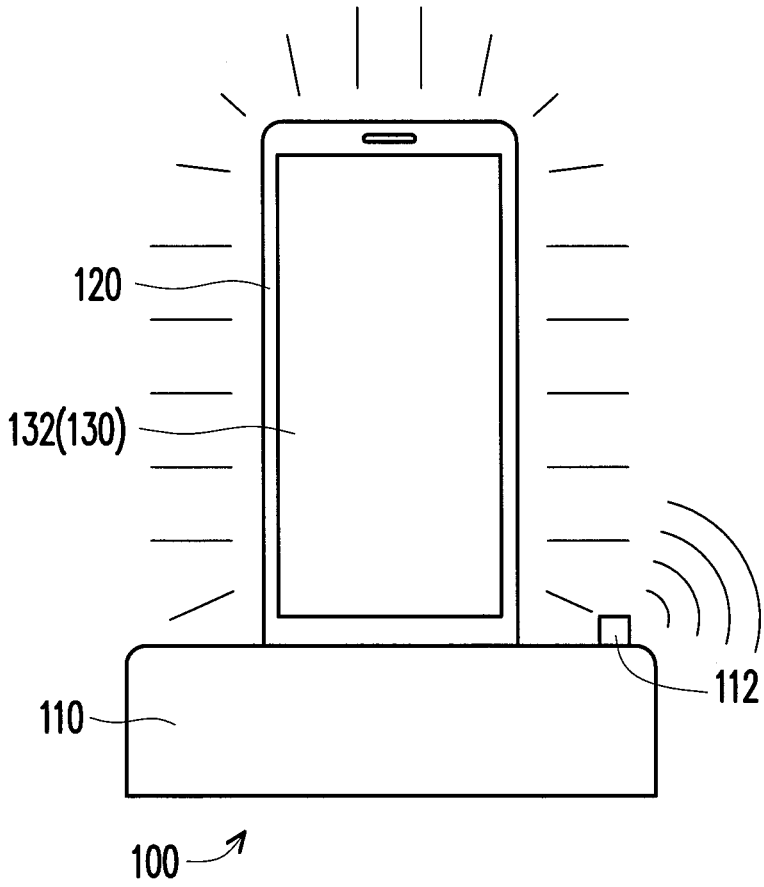
FIG. 3A is a front-view diagram of the electronic apparatus of FIG. 1A in another state.
Figure 3B:
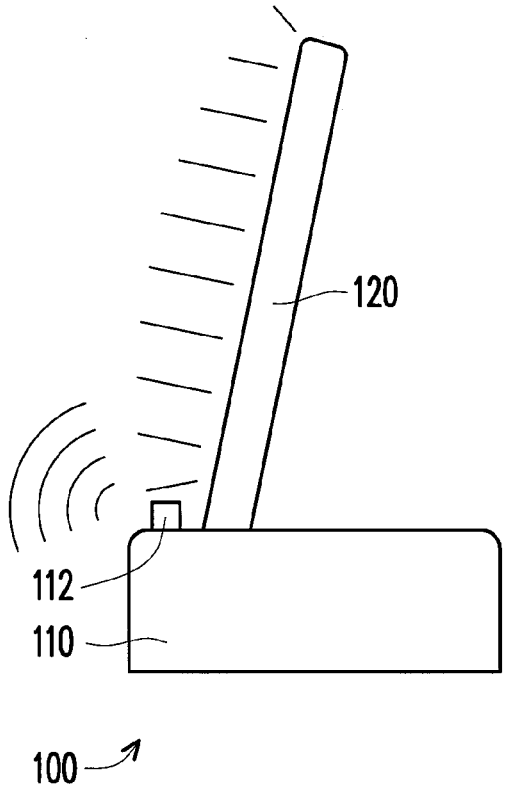
FIG. 3B is a side-view diagram of the electronic apparatus of FIG. 3A.

FIG. 3A is a front-view diagram of the electronic apparatus of FIG. 1A in another state and FIG. 3B is a side-view diagram of the electronic apparatus of FIG. 3A. Referring to FIGS. 2, 3A and 3B, for example, when the warning indicators 130 are two displays 132 respectively disposed at the handheld electronic device 120 and the cradle 110, the display 132 of the handheld electronic device 120 emits an emergency illumination light, while the display 132 of the cradle 110 may display the present time for a user moving in an environment with insufficient light, in which the display 132 of the embodiment may be a liquid crystal display (LCD) or an organic light-emitting diode display (OLED display).

When the warning indicators 130 are a display 132 and a speaker 134 respectively disposed at the handheld electronic device 120 and the cradle 110, the handheld electronic device 120 may emit the above-mentioned emergency illumination light, while the cradle 110 may sound with a prompt music. In this way, in addition to assist the user in moving in an environment with insufficient light, the disclosure may also prompt that the user is moving.

When the warning indicators 130 are a vibrator 136 and a display 132 respectively disposed at the handheld electronic device 120 and the cradle 110, the handheld electronic device 120 may produce vibration and the cradle 110 may display the above-mentioned present time. In this way, in addition to assisting the user in moving in an environment with insufficient light, the disclosure would not interfere other users in their rests. The disclosure does not limit the warning indicators 130 to being disposed at one of the handheld electronic device 120 and the cradle 110, or at both the warning indicator 130 and the cradle 110, and moreover does not limit the combination of a group consisting of the warning indicators 130. The above-mentioned embodiment is an example, the user may adjust the combination of the warning indicators 130 according to the practical requirement so as to generate different sensory warning combinations.

Referring to FIGS. 1A and 2, when the handheld electronic device 120 of the embodiment is a smartphone, the warning indicator 130 includes a display 138. The display 138 is disposed at a front surface 120*a* of the handheld electronic device 120, and the display 138 is a touch display which occupies an area more than a half of the front surface 120*a* of the handheld electronic device 120. The handheld electronic device 120 further has a wireless communication module 124, in which the wireless communication module 124 is electrically connected to the microprocessor 122 and enables the handheld electronic device 120 performing communication.

The cradle 110 of the embodiment further has a recess 110*a*, and the recess 110*a* extends towards the interior of the cradle 110. When the handheld electronic device 120 is installed onto the cradle 110, the recess 110*a* is configured for accommodating a portion of the handheld electronic device 120. In addition, the handheld electronic device 120 further has a first connector 126, and the cradle 110 further has a second connector 116. When the portion of the handheld electronic device 120 is accommodated at the recess 110*a*, the first connector 126 and the second connector 116 are connected to each other, so as to make the cradle 110 and the handheld electronic device 120 connected to each other.

The cradle 110 further has a charging module 118. The charging module 118 is electrically connected to the control module 114 and is capable of charging the handheld electronic device 120. In more details, the charging module 118 is suitable to store an electrical power come from outside (not shown), and when the handheld electronic device 120 is installed onto the cradle 110, the charging module 118 may charge the handheld electronic device 120.

Figure 4:
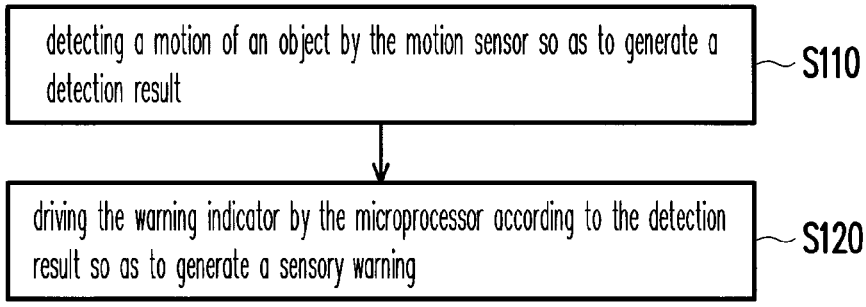
FIG. 4 is a workflow chart of a sensory warning generating method according to an embodiment of the disclosure.

FIG. 4 is a workflow chart of a sensory warning generating method according to an embodiment of the disclosure. Referring to FIGS. 1A, 2 and 4, in the embodiment, the sensory warning generating method is suitable for a cradle 110, a handheld electronic device 120 and a warning indicator 130. The cradle 110 has a motion sensor 112, the handheld electronic device 120 is installed on the cradle 110 and has a microprocessor 122, and the warning indicator 130 may be disposed on the handheld electronic device 120 or the cradle 110, or both the handheld electronic device 120 and the cradle 110. The sensory warning generating method includes following steps: in step S110 first, detecting a motion of an object (not shown) by the microprocessor 122 so as to generate a detection result; then in step S120, driving the warning indicator 130 by the microprocessor 122 according to the detection result so as to generate a sensory warning, in which the warning indicator 130 is a combination selected from a group consisting of a display 132, a speaker 134 and a vibrator 136 and the sensory warning is a combination selected from a group consisting of an optical signal, an acoustic signal and a vibration signal. By means of generating the sensory warning, the disclosure expands the applications of the handheld electronic device 120 and the cradle 110 after combining them.

Taking an example, when a motion starts, the intensity of the sensory warning is output increasingly. After that, when the motion goes on, the intensity of the sensory warning is continuously output. Finally, when the motion is interrupted, the intensity of the sensory warning is decreasingly output until the intensity of the sensory warning comes to zero.

Referring to FIGS. 3A and 3B, for example, if the warning indicator 130 is a display 132 disposed on the handheld electronic device 120 or the cradle 110, and when the motion sensor 112 detects out a motion (for example, a human body starts moving), the display 132 would output a soft and gradually-brighter illumination light for the user to identify the ambient environment thereof. Then, when the motion sensor 112 detects out the motion of the human body keeps going (for example, the human body continues moving), the display 132 would continuously output a light with a stable luminance. Finally, when the motion sensor 112 detects out the motion is interrupted (for example, a human body stops moving), the display 132 would output a soft and dimming illumination light until the display 132 is turned off. In this way, the sensory warning may be output with an increasing intensity or a decreasing intensity, and the above-mentioned control method is indeed a user-friendly scheme.

In summary, the disclosure uses the motion sensor of the cradle to detect a motion of an object, by which the warning indicator of the handheld electronic device or the cradle may generate a sensory warning. By means of generating the sensory warning, the disclosure expands the various applications of the handheld electronic device and the cradle after combining them so as to meet the requirements of users.

It will be apparent to those skilled in the art that the descriptions above are several preferred embodiments of the disclosure only, which does not limit the implementing range of the disclosure. Various modifications and variations may be made to the structure of the disclosure without departing from the scope or spirit of the disclosure. The claim scope of the disclosure is defined by the claims hereinafter.

What is claimed is:

1. An electronic apparatus, comprising:

a cradle, having a motion sensor and a charging module, wherein the motion sensor generates a detection result when a motion of an object is detected by the motion sensor; and a handheld electronic device, installed on the cradle, the handheld electronic device having a microprocessor and a display, the charging module charging the handheld electronic device when the handheld electronic device installed on the cradle, wherein when the microprocessor receives the detection result, the display outputs illumination with gradually increasing intensity and when the microprocessor does not receives the detection result, the display outputs illumination with gradually decreasing intensity.

2. The electronic apparatus as claimed in claim 1, wherein the display is a liquid crystal display (LED) or an organic light-emitting diode display (OLED display).

3. The electronic apparatus as claimed in claim 1, wherein the display is disposed at a front surface of the handheld electronic device and the display is a touch display and occupies an area more than a half of the front surface.

4. The electronic apparatus as claimed in claim 1, wherein the cradle further has a recess to accommodate a portion of the handheld electronic device.

5. The electronic apparatus as claimed in claim 4, wherein the handheld electronic device further has a first connector and the cradle further has a second connector, and when the portion of the handheld electronic device is accommodated at the recess, the first connector and the second connector are connected to each other.

6. The electronic apparatus as claimed in claim 1, wherein the cradle further has a control module, and the control module is electrically connected to the motion sensor to transmit the detection result to the microprocessor.

7. The electronic apparatus as claimed in claim 6, wherein the warning indicator is disposed on the handheld electronic device and electrically connected to the control module, and the microprocessor, by using the control module to drive the display.

8. The electronic apparatus as claimed in claim 1, wherein the handheld electronic device further has a wireless communication module, the wireless communication module is electrically connected to the microprocessor.

9. An electronic apparatus, comprising:

a cradle, having a motion sensor and a warning indicator, wherein the motion sensor generates a detection result when a motion of an object is detected by the motion sensor; and a handheld electronic device, installed onto the cradle, the handheld electronic device having a microprocessor, wherein the microprocessor drives the warning indicator to generate a sensory warning according to the detection result.

10. The electronic apparatus as claimed in claim 9, wherein the warning indicator is a combination selected from a group consisting of a display, a speaker and a vibrator.

11. The electronic apparatus as claimed in claim 10, wherein the display is a liquid crystal display (LED) or an organic light-emitting diode display (OLED display).

12. The electronic apparatus as claimed in claim 9, wherein the sensory warning is a combination selected from a group consisting of an optical signal, an acoustic signal and a vibration signal.

13. The electronic apparatus as claimed in claim 9, wherein the cradle further has a recess to accommodate a portion of the handheld electronic device.

14. The electronic apparatus as claimed in claim 13, wherein the handheld electronic device further has a first connector and the cradle further has a second connector, and when the portion of the handheld electronic device is accommodated at the recess, the first connector and the second connector are connected to each other.

15. The electronic apparatus as claimed in claim 9, wherein the cradle further has a control module, and the control module is electrically connected to the motion sensor to transmit the detection result to the microprocessor.

16. The electronic apparatus as claimed in claim 15, wherein the warning indicator is disposed on the cradle and electrically connected to the control module, and the microprocessor, by using the control module to drive the warning indicator, generates the sensory warning according to the detection result.

17. The electronic apparatus as claimed in claim 9, wherein the cradle further has a charging module, and the charging module is able to charge the handheld electronic device.

18. The electronic apparatus as claimed in claim 9, wherein the handheld electronic device further has a wireless communication module, the wireless communication module is electrically connected to the microprocessor and the wireless communication module is able to make the handheld electronic device perform communication.

19. A sensory warning generating method for a cradle and a handheld electronic device, wherein the cradle has a motion sensor and a charging module, the handheld electronic device is installed on the cradle and has a microprocessor, a display disposed on the cradle or the handheld electronic device, the charging module charges the handheld electronic device when the handheld electronic device installed on the cradle, and the sensory warning generating method comprises:

detecting a motion of an object by the motion sensor so as to generate a detection result;

outputting illumination with gradually increasing intensity by the display when the microprocessor receives the detection result; and outputting illumination with gradually decreasing intensity by the display when the microprocessor does not receives the detection result.

20. The sensory warning generating method as claimed in claim 19, wherein the display is a liquid crystal display (LED) or an organic light-emitting diode display (OLED display).

21. The sensory warning generating method as claimed in claim 19, wherein when the motion is continued, the intensity of the illumination is durably output.

* * * * *